US007380592B2

(12) United States Patent
Atkins et al.

(10) Patent No.: US 7,380,592 B2
(45) Date of Patent: Jun. 3, 2008

(54) PRESSURE CONTROL TOOL FOR MODLUATING PRESSURE IN A PORTION OF A WELLBORE

(76) Inventors: Nicholas Atkins, Birkwood, Banchery, Aberdeen, AB31 6HY, Scotland (GB); Phillip Egleton, 4 Ladywell Crescent, Aboyne, Aberdeen, Scotland (GB); Craig Spalding, Units 1-3, Hareness Road, Altens, Aberdeen AB12 3LE, Scotland (GB)

( * ) Notice: Subject to any disclaimer, the term of this patent is extended or adjusted under 35 U.S.C. 154(b) by 142 days.

(21) Appl. No.: 10/962,369

(22) Filed: Oct. 8, 2004

(65) Prior Publication Data

US 2005/0098313 A1 May 12, 2005

(30) Foreign Application Priority Data

Oct. 9, 2003 (GB) ..... 0323627.0

(51) Int. Cl.
*E21B 33/126* (2006.01)

(52) U.S. Cl. ..... 166/202; 166/196; 277/335

(58) Field of Classification Search ..... 166/202, 166/153, 121, 196; 277/335–337, 339, 322, 277/558, 611, 616, 618, 619, 624, 629
See application file for complete search history.

(56) References Cited

U.S. PATENT DOCUMENTS

| | | | | |
|---|---|---|---|---|
| 2,295,770 | A * | 9/1942 | Baker | 277/337 |
| 2,325,556 | A | 7/1943 | Taylor, Jr. et al. | |
| 2,804,325 | A * | 8/1957 | Riesing | 277/559 |
| 2,862,559 | A * | 12/1958 | Brown | 166/121 |
| 3,278,191 | A | 10/1966 | Tamplen | |
| 3,422,902 | A * | 1/1969 | Bouchillon | 166/202 |
| 4,023,814 | A | 5/1977 | Pitts | |
| 4,379,558 | A | 4/1983 | Pippert | |
| 4,509,763 | A | 4/1985 | Fischer | |
| 4,809,989 | A | 3/1989 | Kernal | |
| 4,921,046 | A | 5/1990 | Caskey | |
| 5,311,938 | A | 5/1994 | Hendrickson et al. | |
| 5,350,017 | A | 9/1994 | Henderson, Jr. | |
| 5,433,269 | A | 7/1995 | Hendrickson | |
| 5,467,822 | A | 11/1995 | Zwart | |
| 5,603,511 | A | 2/1997 | Keyser, Jr. et al. | |
| 2002/0139541 | A1 | 10/2002 | Sheffield et al. | |

FOREIGN PATENT DOCUMENTS

| | | |
|---|---|---|
| GB | 2266908 | 11/1993 |
| GB | 2386141 | 9/2003 |
| WO | WO 93/05267 | 3/1993 |

OTHER PUBLICATIONS

Pages From Weatherford-Guiberson Product Catalog RE GW Cup-Type Packers and Cups.
UK Patent Office Search Report for Application No. GB0422336.8 with cited references.

* cited by examiner

*Primary Examiner*—Kenneth Thompson
(74) *Attorney, Agent, or Firm*—Stephen M. Nipper; Dykas, Shaver & Nipper, LLP

(57) ABSTRACT

A pressure control device for mounting on a mandrel includes a flexible cup member, a rigid support member and an anti extrusion portion of greater hardness than the cup member located at an outer portion of the cup member. The cup member is bonded only to selected areas of the anti extrusion portion and the support member, thereby permitting relative movement between other areas of contact.

26 Claims, 2 Drawing Sheets

PRESSURE CONTROL TOOL FOR MODLUATING PRESSURE IN A PORTION OF A WELLBORE

PRIORITY

This application claims the priority date of the British application entitled Downhole Tool filed by Atkins et al. on Oct. 9, 2003 with application serial number 0323627.0.

FIELD OF THE INVENTION

The present invention relates to a downhole tool for use in oil and gas wells; in particular, the invention relates to a pressure control tool for modulating pressure in a portion of a wellbore.

SUMMARY OF THE INVENTION

In the oil and gas exploration and extraction industries it is often desirable to be able to modulate downhole pressure when required. For example, it may be desirable to isolate a section of well bore to create sections of differential pressure within the bore. A sealing device may be used to create a seal within the bore, such that fluid pressure on one side of the seal increases relative to fluid pressure on the other side. Further, a temporary decrease in well pressure can be used to initiate flow from the reservoir in a process known as 'swabbing'. One means of doing this is to make use of a swab cup, which is a cup-shaped resilient member which is lowered on a mandrel into the well. As a pressure differential develops across the cup, the walls of the cup are pushed into contact with the well tubing or bore wall, thereby sealing a portion of the well. Thus, the pressure below the cup may decrease, while the pressure above may increase.

Similarly-constructed pressure cups are also used in a wide variety of other sealing and fluid lifting applications. For example, variations in pressure may also be used to actuate or to control other downhole tools and instruments which rely on fluid pressure for their operation. Such cups may be constructed with an outer diameter slightly less than the bore diameter, such than an initial inflation is required before a seal is created, or may have an outer diameter slightly larger than that of the bore, such that a seal is present even when the cup is not inflated.

Conventional pressure cups suffer from a number of disadvantages. The cups are usually made from rubber or other elastomer, which must be made relatively thick in order to resist the pressures downhole. This means that such cups may be unsuitable for use at relatively low pressures, since they will not seal the well effectively under these conditions. The relatively thick elastomer can also suffer from slow recovery times after pressure has been removed. Cups may be reinforced in order to resist higher pressures with metal or wire hoops or rings embedded within the elastomer; however, this can lead to shear failure of the elastomer, with the reinforcing wire cutting through the elastomer.

In addition, conventional cups may only operate over a restricted range of pressures and temperatures, and with a small gap between the cup and the bore wall. If the gap between the cup and the bore is increased, the pressure the cup will hold drops considerably.

Further, elastomers under pressure can flow in certain conditions. This may arise in cups, and will reduce the effectiveness of such cups, as elastomer is made to flow while the cup is under pressure. Any tendency to flow is also exacerbated at higher temperatures.

It is among the objects of embodiments of the present invention to obviate or alleviate these and other disadvantages of conventional pressure cups.

SUMMARY OF THE INVENTION

According to a first aspect of the present invention, there is provided a pressure control device for mounting on a mandrel, the device comprising:

a support member; and a flexible cup member mounted to the support member;

wherein the cup member is selectively bonded to the support member to permit relative movement therebetween.

In use, the control device may be lowered downhole on a mandrel, wireline or the like. When the cup walls are placed against the bore wall, fluid flow past the cup is restricted such that fluid pressure will build up behind the cup, maintaining the walls of the cup outward against the bore wall and creating a seal between the cup and the bore wall. The cup walls may be placed against the bore wall through using a cup of slightly greater diameter than the bore; or the cup may be given an initial expansion by for example an expansion ring or the like which urges the cup walls outward.

It has surprisingly been found that it is not necessary to bond together the cup member and the support member over the whole of their respective contact areas, and that selective bonding over only a portion of the contact area may be used. Indeed, it has been surprisingly identified that use of only partial bonding actually improves performance of the device.

It is believed that, because the cup is only selectively bonded to the support member, portions of the cup are able to move relative to the support member during deformation of the device. This has two key advantages: firstly, portions of the cup may elongate relative to the support member when under pressure, so giving a greater response to relatively low pressures; and secondly, that portion of the cup may be made of softer or thinner material than otherwise. The softer or thinner portion of the cup will respond to a lower pressure, and will also deform to a greater extent, than thicker material, so providing a more effective seal at low pressures.

Further, the degree of deformation and expansion of the cup will depend on the pressure to which the cup is exposed; under very high pressures, greater deformation will be experienced than under lower pressures. This contrasts with conventional, more rigid, cups which deform only to a limited extent under pressure up to a level which depends on the cup construction. When this level is exceeded, a conventional cup may burst or otherwise catastrophically fail.

When pressure is released from the device, the thinner cup will have a greater resilience than would thicker material, and is able to return to its original diameter more rapidly.

Preferably the support member comprises a rigid body adapted for mounting on a mandrel or the like. The body may comprise an annular member. In certain embodiments, the annular member may comprise a plurality of axially-extending structural elements, such as fingers, plates, flutes or the like. The structural elements may be anchored at one end to a connecting ring, or may be connected by a flexible member such as a chain, tie, cable, or the like. Circumferential edges of the structural elements may overlap one another. This provides a support member which is capable of circumferentially expanding and contracting, and which has some degree of flexibility, which may be useful for certain applications.

The support member may further comprise a circumferentially extending spring located at an outer portion of the cup member. This spring assists in recovery of the cup from expansion. In certain embodiments of the invention, the spring may also be urged outward against the bore wall in use, to help to create the seal. The spring may also provide some degree of anti extrusion function.

Preferably the spring is a helical spring. The spring may be a garter spring. Alternative spring forms may be used.

The spring is preferably located so as to abut the body of the support member. This restricts movement of the spring to some degree when the device is pressurised, and may be used to direct movement of the spring to improve formation of a seal. Conveniently the body of the support member comprises a cammed surface which is abutted by the spring. The cam may be arranged to direct the spring radially outward when the device is under pressure; conveniently, this is achieved by the cam being inclined axially downwardly from the centre of the device and radially outward. Alternatively the cam may be inclined upwardly, or may be generally horizontal; these arrangements may be used to delay or restrain expansion of the spring and cup, which may be useful in certain applications.

The spring may be bonded to the cup member, but is preferably not bonded thereto, and is simply located on or adjacent the cup member.

Preferably the support member further comprises an anti extrusion portion of greater hardness than the cup member located at an outer portion of the cup member. The anti extrusion portion being of greater hardness than the cup itself will be less susceptible to flow due to the pressure, so improving effectiveness of the cup. This feature also allows the cup to be made of somewhat thinner or less hard material than conventional cups.

Suitable materials for the various components include, but are not limited to elastomers such as nitrile, hydrogenated nitrile, fluoroelastomers, perfluoroelastomers, thermoplastic materials, EPDM, polyurethane, and the like for the cup and/or the anti extrusion material; metals such as steel, brass, or the like, or polymeric materials for the spring; and metals such as steel, brass or copper, or plastics such as PEEK, nylon, and the like for the support member body.

In certain embodiments of the invention, the anti extrusion portion may be mounted within the spring, where present. For example, the spring may be a helical spring including a core of harder anti extrusion material. This arrangement reduces the risk of the cup material from flowing into and within the spring.

It is preferred, however, that the anti extrusion portion is located adjacent the spring at an outer portion of the cup member. At least a portion of the anti extrusion portion may be located radially inwardly of the spring, where present.

Preferably the anti extrusion portion comprises a generally annular member abutting the cup member; conveniently the anti extrusion portion is located outwardly of the cup member. Preferably also the anti extrusion portion is located adjacent the spring. In certain embodiments of the invention, the spring may be incorporated within the anti extrusion portion; alternatively, the spring may be bonded thereto.

Preferably the anti extrusion portion comprises a free end which is not bonded to the cup member. Preferably also the anti extrusion portion comprises a bonded end which is bonded to the cup member. The free end allows movement and expansion of the cup member relative to the anti extrusion portion, while the bonded end serves to both retain the anti extrusion portion in place relative to the cup member, and further reduces the risk of flow of the cup member. In preferred embodiments of the invention, the spring is located adjacent the free end of the anti extrusion portion; this allows the combination of the spring and the anti extrusion portion to move relative to the cup member when under pressure.

Preferably the cup member is selectively bonded to the body of the support member and the anti extrusion portion; thus, the cup member is not necessarily bonded to the spring. Preferably also a portion of the cup member is bonded to a portion of the body of the support member, and a further portion of the cup member is bonded to a portion of the anti extrusion portion. It is preferred that bonding of the cup to the support member occurs only in two spaced portions of the cup.

Any suitable means may be used to bond the components of the device; for example, glue or other adhesive, welding, vulcanisation, heat treatment, mechanical fasteners, bonding agents, and the like.

According to a further aspect of the present invention, there is provided a pressure control device for mounting on a mandrel, the device comprising:

a flexible cup member mounted to at least one of:

a) a rigid support member;

b) a circumferentially extending spring located at an outer portion of the cup member; and c) an anti extrusion portion of greater hardness than the cup member located at an outer portion of the cup member;

wherein the cup member is selectively bonded to at least one of the spring, the anti extrusion portion, and the support member, to permit relative movement at contact areas therebetween.

BRIEF DESCRIPTION OF THE DRAWINGS

These and other aspects of the present invention will now be described by way of example only and without limitation, with reference to the accompanying drawings in which.

DETAILED DESCRIPTION OF THE DRAWINGS

Figure 1:
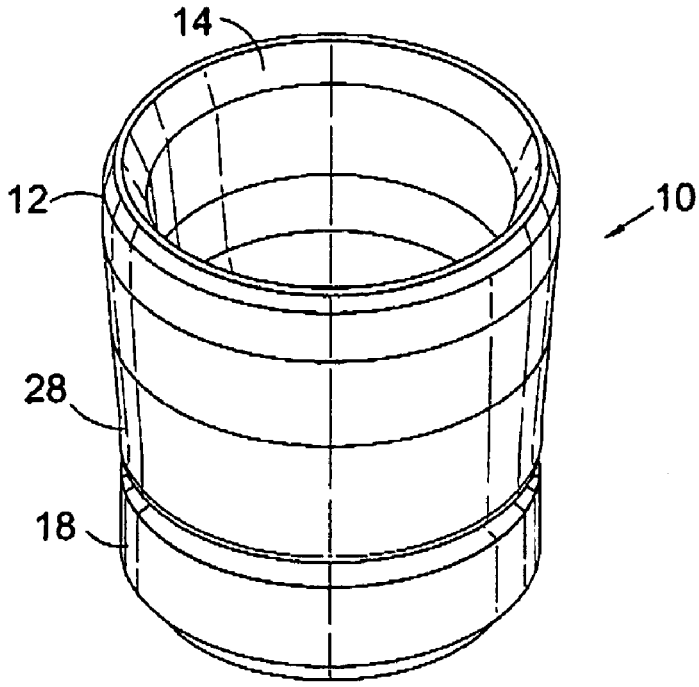
FIG. 1 is perspective view of a well sealing device in accordance with a preferred embodiment of the present invention.
Figure 2:
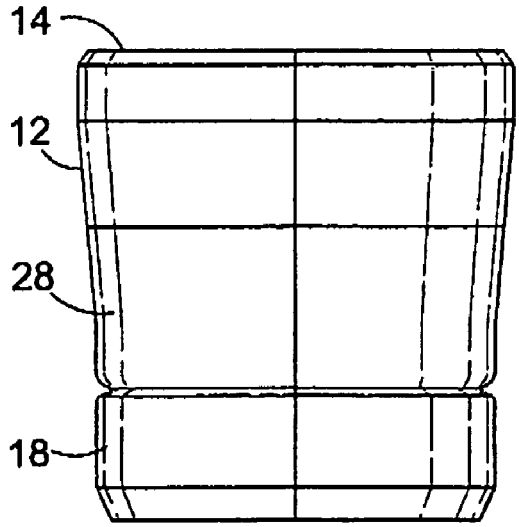
FIG. 2 is a side view of the device of FIG. 1.
Figure 3:
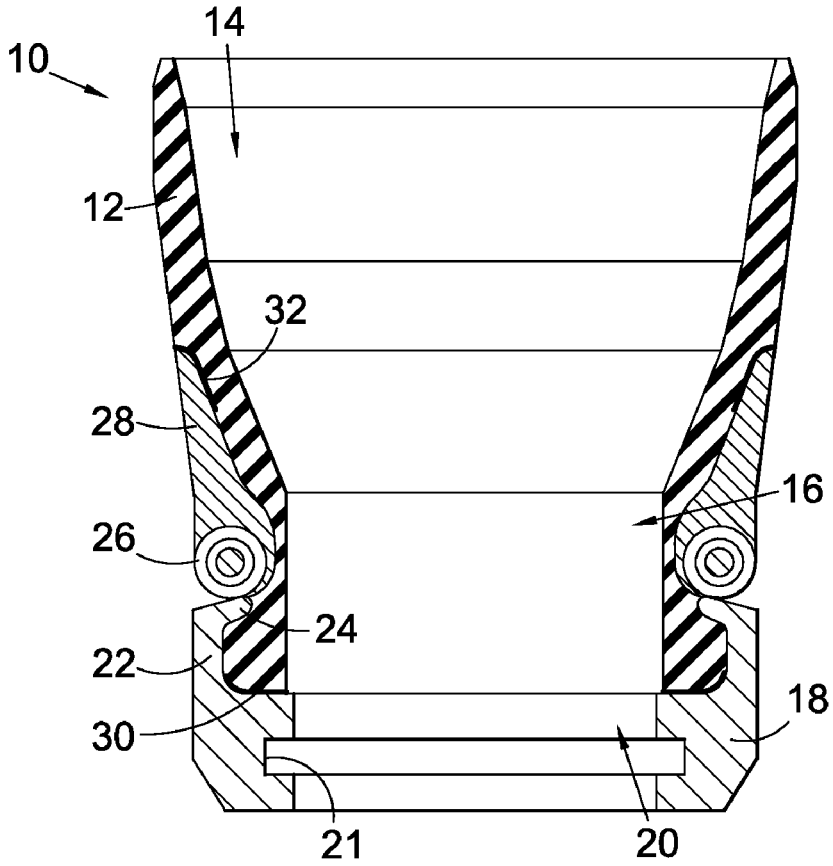
FIG. 3 is a sectional view of the device of FIG. 1.

The Figures show a pressure control device in the form of a pressure cup 10, which may be used for sealing or modulating pressure in a well bore. The pressure cup 10 comprises a relatively soft, flexible elastomeric cup member 12, defining a generally conical open end 14, tapering towards a lower cylindrical portion 16 (FIG. 3). The cup member 12 is mounted on a metal support member 18, which includes a through bore 20 and a sealing O-ring groove 21 making it suitable for mounting to a mandrel; this may in use be lowered downhole. The support member 18 includes a cylindrical lip 22 extending axially beyond the lower edge of the cup member 12, and having a radially-inwardly extending flange portion 24. This flange portion defines a cammed surface on which a helical garter spring 26 rests, which spring extends circumferentially about the narrowest portion of the cup member 12. The flange portion 24 also serves to assist in mounting the cup member and the support member together, as the flange portion 24 and the lip 22 together define an undercut. The spring 26 is integrally mounted in an annular anti extrusion member 28; this is formed of a relatively hard material (that is, harder than the elastomer of the cup member 12). The anti extrusion member 28 extends axially upwardly from the spring 26 to, in this case, about half way along the length of the cup member; the relative dimensions of the various components may of course vary.

The cup member 12 is securely bonded by means of adhesive to the other components of the pressure cup in only two locations. Firstly, at the base of the cup member 12 where it abuts the support member 18, and secondly at the edge of the anti extrusion member 28 which is axially furthest from the spring 26. Each of these bonding locations is indicated on the Figure by thicker shading, and reference numerals 30, 32. Aside from these two bonded regions, the portions of the cup member 12 in contact with the other components of the pressure cup are not bonded together.

In use, the pressure cup operates as follows. The support 18 is secured to a mandrel, and the device 10 is lowered downhole, with the open end 14 of the cup member 12 directed uphole. Once the device 10 has been lowered to the desired operating depth, a fluid impulse is applied from surface, which causes an increase in fluid pressure within the cup member 12. The upper edges 14 of the cup member 12 are inflated by this increase in pressure, and expand into contact with the bore wall, thereby preventing further fluid flow past the device 10.

As pressure within the cup member 12 increases further, the portion of the cup member adjacent the spring 26 experiences an increase in pressure, and deforms outwards, so pushing the spring 26 outwards; the cammed surface of the flange 24 of the support serves to guide the spring 26 outward and downward into contact with the bore wall. This improves the seal created by the device 10, while the anti extrusion member is also forced into contact with the bore wall, and serves to prevent flow of the softer cup member 12 between the bore wall and the support member 18 or the spring 26.

The relatively large unbonded surface area of the cup member 12 allows the cup member to inflate and stretch without being restricted unduly by the anti extrusion member 28 or the spring 26; however, the presence of these components prevents the cup member 12 from inflating beyond a certain limit, which can help to prevent damage to the cup member. Further, the effective double layer construction allows the cup member 12 to respond to pressures significantly below what would otherwise be the case with conventional pressure cups, which require a more robust construction.

On release of the pressure on the pressure cup, the resilience of the cup member 12 in combination with the spring 26 return the cup to its original shape, and allow fluid to flow through the wellbore once more. Since the cup member is softer and thinner than would be the case with conventional pressure cups, recovery time is less also.

In addition to the use described above, pressure cups according to the present invention may be used in a variety of ways. The outer diameter of the cup member may be made slightly greater than the inner diameter of the bore wall such that an initial seal is formed without the initial application of pressure. Cups may be run into the well in pairs separately or integrated into a single device, with the open ends of the cups either facing one another, or directed away from one another; such an arrangement may be used to form a packing tool for isolating a section of the bore.

It will be understood that the foregoing is for illustrative purposes only, and that various improvements and modifications may be made to the apparatus described herein without departing from the scope of the invention.

We claim:

1. A pressure control device for mounting on a mandrel, the device comprising:

a support member, said support member comprising a rigid body and a circumferentially extending spring located at an outer portion of the cup member, wherein said spring abuts said body; and a flexible cup member mounted to the support member, the cup member having an external surface portion for forming a seal with an internal bore surface and a circumferentially extending spring located at an outer portion of the cup member, wherein said spring abuts said body;

wherein the cup member is bonded to the support member over a first portion of a contact area between the support member and the cup member and is not bonded to the support member over a second portion of said contact area to permit relative movement between the support member and the cup member at said second portion.

2. The pressure control device of claim 1, wherein the support member comprises a rigid body adapted for mounting on a mandrel.

3. The pressure control device of claim 2, wherein the body comprises an annular member.

4. The pressure control device of claim 1, wherein the spring is adapted to restrict extrusion of the cup member.

5. The pressure control device of claim 1, wherein the spring is a helical spring.

6. The pressure control device of claim 1, wherein the spring is a garter spring.

7. The pressure control device of claim 1, wherein the body of the support member comprises a cammed surface which is abutted by the spring.

8. The pressure control device of claim 7, wherein the cammed surface is arranged to direct the spring radially outward when the device is under pressure.

9. The pressure control device of claim 1, wherein the spring is located on or adjacent the cup member.

10. The pressure control device of claim 1, wherein the spring is bonded to the cup member.

11. The pressure control device of claim 1, wherein the support member comprises an anti extrusion portion of greater hardness than the cup member located at an outer portion of the cup member.

12. The pressure control device of claim 11, wherein the support member further comprises a circumferentially extending spring located at an outer portion of the cup member.

13. The pressure control device of claim 12, wherein at least a part of the anti extrusion portion is provided within the spring.

14. The pressure control device of claim 12, wherein at least a part of the anti extrusion portion is located adjacent the spring at an outer portion of the cup member.

15. The pressure control device of claim 12, wherein at least a part of the anti extrusion portion is located radially inwardly of the spring.

16. The pressure control device of claim 11, wherein the anti extrusion member comprises a generally annular member abutting the cup member.

17. The pressure control device of claim 11, wherein the anti extrusion portion is located radially outwardly of the cup member.

18. The pressure control device of claim 12, wherein the anti extrusion portion is located adjacent the spring.

19. The pressure control device of claim 12, wherein the spring is incorporated within the anti extrusion portion.

20. The pressure control device of claim 12, wherein the spring is bonded to the anti extrusion portion.

21. The pressure control device of claim 11, wherein the anti extrusion portion comprises a bonded end which is bonded to the cup member.

22. The pressure control device of claim 21, wherein the anti extrusion portion comprises a free end which is not bonded to the cup member.

23. The pressure control device of claim 22, wherein a circumferentially extending spring is located adjacent the free end of the anti extrusion portion.

24. The pressure control device of claim 11, wherein the support member comprises a rigid body and the cup member is selectively bonded to the said body and the anti extrusion portion.

25. The pressure control device of claim 24, wherein a portion of the cup member is bonded to a portion of the body of the support member, and a further portion of the cup member is bonded to a part of the anti extrusion portion.

26. The pressure control device of claim 24, wherein bonding of the cup member to the support member occurs at two spaced portions of the cup member.

* * * * *